US009062871B2

(12) United States Patent
Medinis

(10) Patent No.: US 9,062,871 B2
(45) Date of Patent: Jun. 23, 2015

(54) LED LAMP WITH AIR-COOLED HEAT SINK

(76) Inventor: David M. Medinis, Fort Myers, FL (US)

( * ) Notice: Subject to any disclaimer, the term of this patent is extended or adjusted under 35 U.S.C. 154(b) by 24 days.

(21) Appl. No.: 12/503,209

(22) Filed: Jul. 15, 2009

(65) Prior Publication Data

US 2011/0013383 A1 Jan. 20, 2011

Related U.S. Application Data

(60) Provisional application No. 61/082,350, filed on Jul. 21, 2008.

(51) Int. Cl.

| | |
|---|---|
| ***F21V 29/00*** | (2006.01) |
| ***F21V 21/084*** | (2006.01) |
| ***F21V 29/02*** | (2006.01) |
| *F21S 8/00* | (2006.01) |
| *F21V 21/32* | (2006.01) |
| *F21Y 101/02* | (2006.01) |

(52) U.S. Cl.

CPC ..... *F21V 21/084* (2013.01); *F21V 29/2293* (2013.01); *F21V 29/025* (2013.01); *F21S 8/033* (2013.01); *F21V 21/32* (2013.01); *F21V 29/02* (2013.01); *F21Y 2101/02* (2013.01)

(58) Field of Classification Search

CPC ..... F21L 4/027; F21L 4/02
USPC ..... 362/373, 294, 105
See application file for complete search history.

(56) References Cited

U.S. PATENT DOCUMENTS

| | | | | |
|---|---|---|---|---|
| 6,908,208 | B1 * | 6/2005 | Hyde et al. | 362/105 |
| 6,955,444 | B2 | 10/2005 | Gupta | |
| 7,108,400 | B2 | 9/2006 | Yamada et al. | |
| 7,144,140 | B2 * | 12/2006 | Sun et al. | 362/373 |
| 7,490,949 | B2 | 2/2009 | Medinis | |
| 2005/0111234 | A1 * | 5/2005 | Martin et al. | 362/555 |
| 2005/0243539 | A1 | 11/2005 | Evans | |
| 2008/0212332 | A1 | 9/2008 | Medinis | |
| 2009/0046465 | A1 * | 2/2009 | Hashimoto et al. | 362/294 |

* cited by examiner

*Primary Examiner* — Julie Bannan
(74) *Attorney, Agent, or Firm* — Arnall Golden Gregory LLP

(57) ABSTRACT

A LED lamp (1) having an air-cooled heat sink (6) enclosed in a housing (2) having a front section (3) and a rear section (4) that holds at least one LED (5) connected to the heat sink. A plurality of cooling vanes (7) extend from the heat sink and heat generated by the at least one LED travels through the heat sink and then through the cooling vanes. The cooling vanes create additional surface area for air to come into contact with, thereby allowing more efficient cooling of the at least one LED. Cooling channels (8) located between the cooling vanes allow for air flow between the cooling vanes. Further, the cooling vanes are angled so that a venturi effect is created as a fan (13) pulls air through the cooling channels, thereby increasing the airflow across the cooling vanes.

10 Claims, 2 Drawing Sheets

LED LAMP WITH AIR-COOLED HEAT SINK

CROSS REFERENCE TO RELATED APPLICATION

This application claims the benefit of U.S. Provisional Application No. 61/082,350 filed on Jul. 21, 2008.

BACKGROUND OF THE INVENTION

This invention relates to head mounted lamps and lights, more particularly, a head mounted light used by surgeons, dentists or other medical personnel or craftsman to illuminate a workspace and allowing the user to have both hands free to perform his or her work.

Currently, head lamps are widely used by surgeons and other medical personnel while performing medical procedures. Head lamps allow surgeons to work freely with both hands while ensuring that the surgeon's work area is adequately illuminated. Many medical personnel use head lamp that are attached to a freestanding light source, and/or to a power outlet or an energy source via fiber optic cable. This poses a problem, because the cable limits the user's movement. In addition there is a possibility that the cable can become tangled in and/or knock over medical equipment. Therefore, many surgeons and other medical personnel prefer to use head lamps that have independent light sources and independent power sources, such as rechargeable battery packs, so that they are not tethered to a fixed location. These types of battery powered head lamps have become popular and widely used. However, battery powered head lamps still pose many limitations mainly due to the heat generated by the light source.

Traditional battery powered head lamps have used Xenon bulbs. However, Xenon bulbs do not provide adequate light and xenon bulbs use too much energy, thereby draining the batteries too quickly. More recent head lamps use light emitting diodes ("LEDs") in an attempt to overcome these problems. However, LEDs generate an excessive amount of heat that can shorten the life of the LEDs, cause discomfort to the user and/or injure the user. Such LEDs typically generate so much heat that a heat sink is required to cool the lamps. A problem with current heat sinks is that they are passively cooled, which does not provide enough heat dissipation. Alternatively, LEDs may be liquid cooled but liquid cooling still does not provide an adequate amount of heat dissipation.

Therefore, a need exists for an air-cooled heat sink for LED lamps that dissipates the heat created by the LED, thereby prolonging the life of the LED and making the LED lamp safer and more comfortable for a user to wear.

The relevant prior art includes the following references:

| Pat. No. (U.S. unless stated otherwise) | Inventor | Issue/Publication Date |
|---|---|---|
| 7,490,949 | Medinis | Feb. 17, 2009 |
| 2008/021,332 | Medinis | Sep. 04, 2008 |
| 7,108,400 | Yamada et al. | Sep. 19, 2006 |
| 6,955,444 | Gupta | Oct. 18, 2005 |
| 2005/0243539 | Evans | Nov. 03, 2005 |

SUMMARY OF THE INVENTION

The primary object of the present invention is to provide a LED lamp with an air-cooled heat sink that prolongs the life of the LEDs.

Another object of the present invention is to provide a LED lamp with an air-cooled heat sink that makes the LED lamp safe to wear.

An even further object of the present invention is to provide a LED lamp with an air-cooled heat sink that makes the LED lamp comfortable for a user to wear.

The present invention fulfills the above and other objects by providing a LED lamp with an air-cooled heat sink comprising a housing having a front section and a rear section that holds at least one LED connected to a heat sink having a plurality of cooling vanes extending therefrom. Heat from the at least one LED travels through the heat sink and then through the cooling vanes. The cooling vanes create additional surface area for air to come into contact with, thereby allowing more efficient cooling of the at least one LED. Cooling channels located between the cooling vanes allow for air flow between the cooling vanes. A cooling chamber that surrounds the heat sink and the cooling vanes allows for air flow around the heat sink and the cooling vanes. A plurality of air inlets located on the surface of the front section of the housing allow for air flow into the front section and cooling chamber. A fan located in the rear housing pulls air through the air inlets into the cooling chamber across the cooling vanes through an exhaust outlet where the fan blows the air into an exhaust chamber located inside the rear housing and finally through exhaust vents located on the rear housing. Further, the cooling vanes are angled so that a venturi effect is created, thereby increasing the airflow across the cooling vanes.

A reflector mounted behind the at least one LED intensifies the light emitted by the at least one LED. A frenzel lens mounted in front of the at least one LED allows a user to focus the light emitted by the at least one LED. The front section of the housing is moveably attached to the rear section so that a user may rotate the front section clockwise and counterclockwise, thereby focusing or unfocusing the light emitted by the at least one LED through the frenzel lens.

The LED lamp is powered by a rechargeable battery pack. In addition, the LED lamp may be worn on the head of a user allowing the user to have free use of both hands or mounted in or around a work area and used as a stationary lamp.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
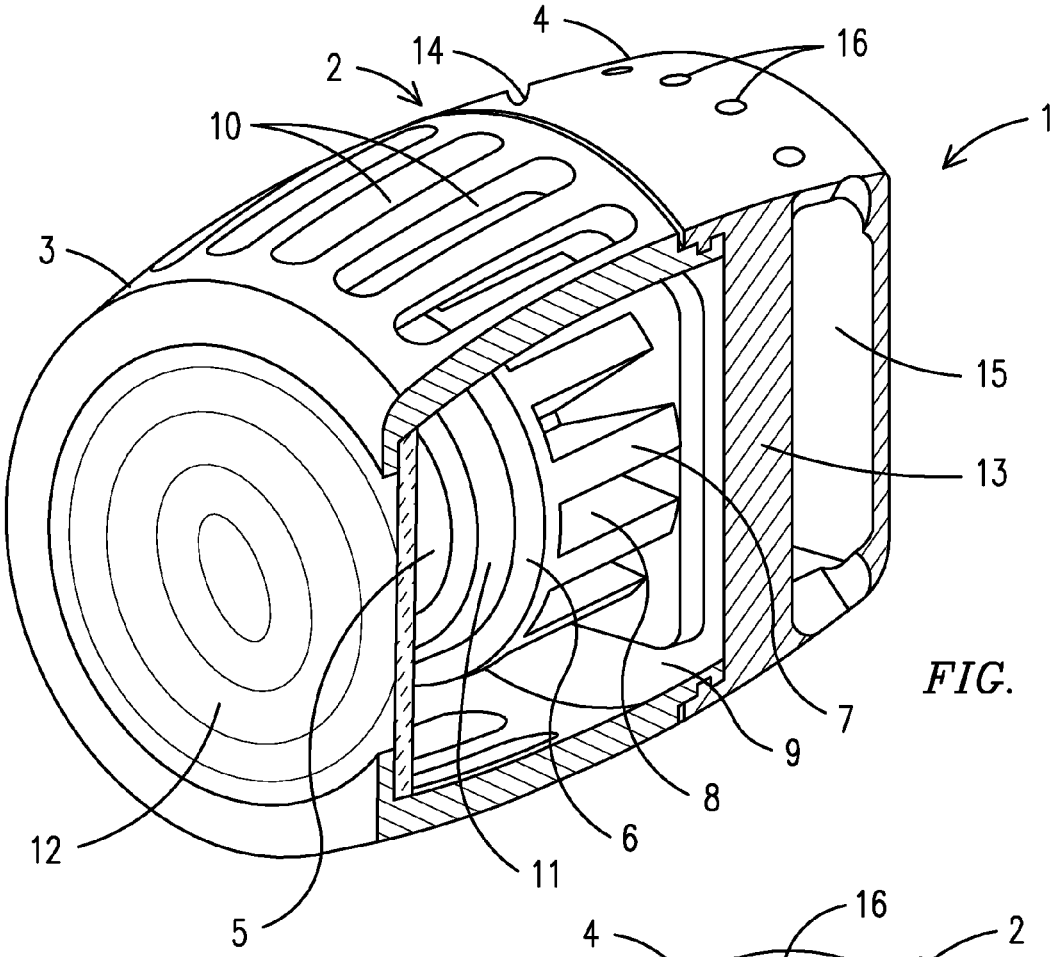
FIG. 1 is a side perspective partial cutaway view of a LED lamp with an air-cooled heat sink of the present invention.

For purposes of describing the preferred embodiment, the terminology used in reference to the numbered accessories in the drawings is as follows:

1. LED lamp
2. housing
3. front section
4. rear section
5. light emitting diode ("LED")
6. heat sink
7. cooling vane
8. cooling channels
9. cooling chamber
10. air inlets
11. reflector
12. frenzel lens
13. fan
14. exhaust outlet
15. exhaust chamber
16. exhaust vents
17. bracket
18. head strap
19. work area
20. head
21. adjustment means
22. battery pack
23. power cord
24. arm
25. mounting bracket With reference to FIG. 1, a side perspective partial cutaway view of a LED lamp 1 with an air-cooled heat sink 6 of the present invention is shown. A housing 2 having a front section 3 and a rear section 4 holds at least one light emitting diode LED 5 connected to a heat sink 6 having a plurality of cooling vanes 7 extending therefrom. Heat created by the at least one LED 5 travels through the heat sink 6 and then through the cooling vanes 7. Cooling channels 8 located between the cooling vanes 7 allow for air flow between the cooling vanes 7. A cooling chamber 9 that surrounds the heat sink 6 and the cooling vanes 7 allows for air flow around the heat sink 6 and the cooling vanes 7. A plurality of air inlets 10 located in the front housing 3 allow for air flow into the front housing 3 and cooling chamber 9. A fan 13 located in the rear section 4 pulls air through the air inlets 10 into the cooling chamber 9 through the cooling channels 8 across the cooling vanes 7 through an exhaust outlet 14 where the fan 13 blows the air into an exhaust chamber 15 located inside the rear section 4 and finally through exhaust vents 16 located on the surface of the rear section 4.

A frenzel lens 12 mounted in front of the at least one LED 5 allows a user to focus the light emitted by at least one LED 5. The front section 3 is moveably attached to the rear section 4 so that a user may rotate the front section 3 clockwise or counterclockwise, thereby focusing or unfocusing the light emitted by the at least one LED 5 through the frenzel lens 12. A reflector 11 mounted behind the at least one LED 5 intensifies the light emitted my the at least one LED 5.

Figure 2:
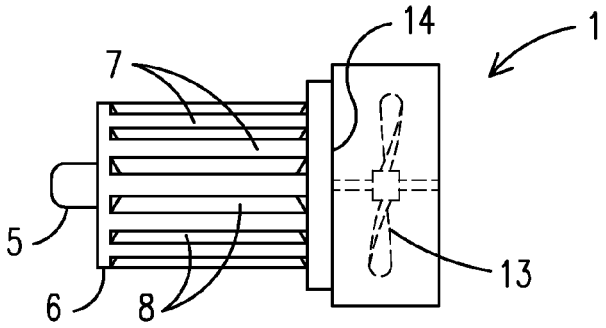
FIG. 2 is a side view of the internal components of a LED lamp with an air-cooled heat sink of the present invention.

Now referring to FIG. 2, a side view of the internal components of a LED lamp 1 having an air-cooled heat sink 6 of the present invention is shown. At least one light emitting diode LED 5 is connected to a heat sink 6 having a plurality of cooling vanes 7 extending therefrom. Heat created by the at least one LED 5 travels through the heat sink 6 and then through the cooling vanes 7. Cooling channels 8 located between the cooling vanes 7 allow for air flow between the cooling vanes 7. A fan 13 pulls air through the cooling channels 8 across the cooling vanes 7 through an exhaust outlet 14 where the fan 13 blows the air into an exhaust chamber 15, as shown in FIG. 1. The cooling vanes 7 create additional surface area for air to come into contact with as air flows through the cooling channels 8, thereby allowing more efficient cooling of the at least one LED 5. Further, the cooling vanes 7 are angled to create a venturi effect as air passes through the cooling channels 8 and through the exhaust outlet 14, thereby increasing the airflow across the cooling vanes 7.

Figure 3:
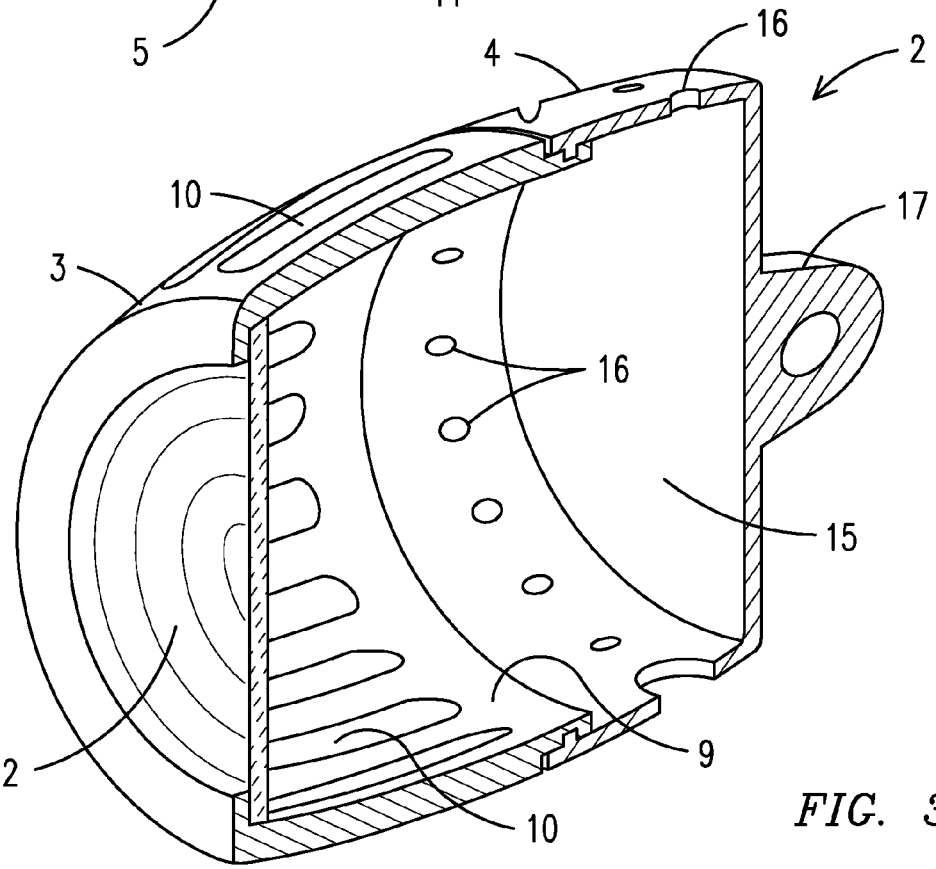
FIG. 3 is a side perspective cutaway view of a housing of the present invention having a front section and a rear section.

Now referring to FIG. 3, a side perspective cutaway view of a housing 2 of the present invention having a front section 3 and a rear section 4 is shown. A plurality of air inlets 10 located in the front housing 3 allow for air flow into the front housing 3 and cooling chamber 9. An exhaust chamber 15 located inside the rear section 4 and finally through exhaust vents 16 located on the surface of the rear section 4. A frenzel lens 12 mounted in front of an at least one LED 5 allows a user to focus the light emitted by the at least one LED 5. The front section 3 is moveably attached to a rear section 4 so that a user may rotate the front section 3 clockwise and counterclockwise, thereby focusing or unfocusing the light emitted by the at least one LED 5 through the frenzel lens 12. A bracket 17 extends from the rear section 4. The bracket 17 may be used for mounting the LED lamp 1 to a head strap 18, as shown in FIG. 4, or the LED lamp may be mounted to or around a work area 19 such as an examination table, surgery table, work bench, etc as shown in FIG. 5.

Figure 4:
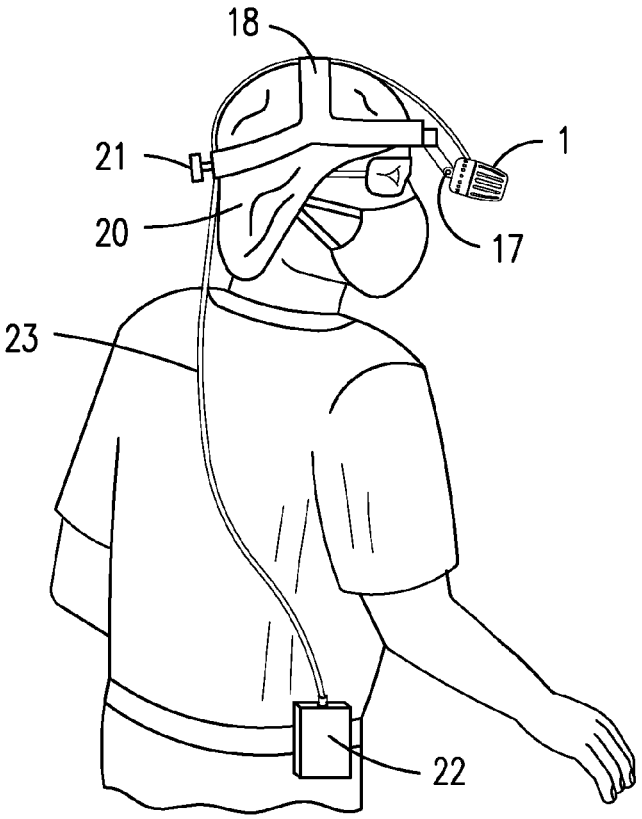
FIG. 4 is a side view of a head-mounted a LED lamp with an air-cooled heat sink of the present invention in use.

Now referring to FIG. 4, a side view of a head-mounted LED lamp 1 with an air-cooled heat sink 6 of the present invention in use. The LED lamp 1 may be mounted by a bracket 17 to a head strap 18 that allows a user to wear the LED lamp 1 on his or her head 20, thereby allowing the user to have free use of both hands. The bracket 17 may be adjustable to allow the user to adjust the angle of the LED lamp 1. In addition, the head strap 18 has an adjustment means 21 to allow the head strap 18 to be fitted to different sized heads. The LED lamp 1 is powered by a rechargeable battery pack 22 that is connected to the LED lamp 1 by a power cord 23.

Figure 5:
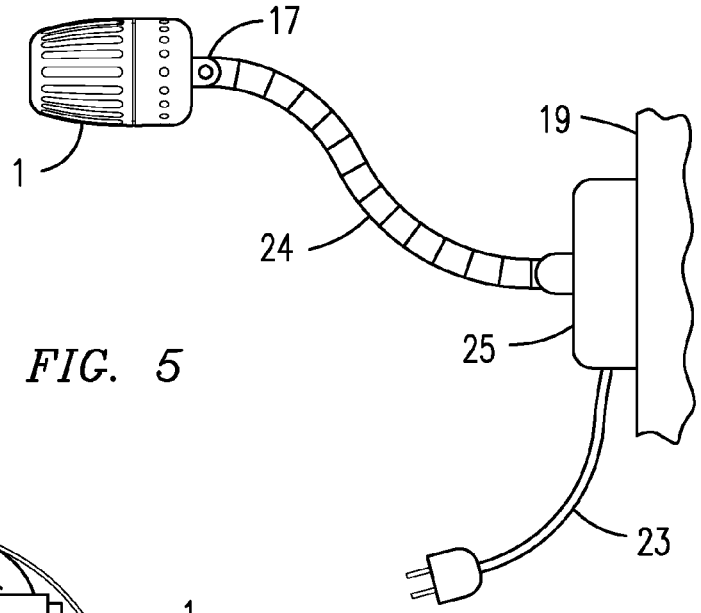
FIG. 5 is a side view of a stationary a LED lamp with an air-cooled heat sink of the present invention mounted to a work area.

Now referring to FIG. 5, a side view of a stationary LED lamp 1 with an air-cooled heat sink 6 of the present invention mounted to a work area 19 is shown. The LED lamp 1 may be attached to an arm 24 via a bracket 17. The arm 24 is secured to a work area 19 via a mounting bracket 25. The stationary LED lamp 1 is powered by a standard wall outlet and power cord 23.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. An LED lamp, comprising:

a housing having a front section and a rear section;

an LED mounted inside of said housing for emitting light;

a Fresnel lens configured in said housing such that light emitted by said LED passes through said Fresnel lens;

a heat sink mounted in said housing and connected to said LED, said heat sink having a cooling vane;

a fan for moving air across said cooling vane;

at least one air inlet defined in a lateral surface of said front section of said housing; and at least one exhaust vent defined in a lateral surface of said rear section of said housing;

wherein said front section of said housing is rotatably connected to said rear section of said housing for relative rotation between said front section of said housing and said rear section of said housing causing focusing or un-focusing of light emitted by said LED and passing through said Fresnel lens.

2. The LED lamp of claim 1, wherein said LED lamp further comprises a cooling chamber defined inside said front section of said housing.

3. The LED lamp of claim 2, wherein said heat sink resides within said cooling chamber, and wherein said cooling chamber is configured to allow air flow around said heat sink.

4. The LED lamp of claim 1, wherein said cooling vane comprises a first cooling vane and said heat sink has a second cooling vane, and wherein a cooling channel is defined between said first cooling vane and said second cooling vane.

5. The LED lamp of claim 4, wherein said first cooling vane is configured relative to said second cooling vane for increasing air flow across said first and second cooling vanes.

6. The LED lamp of claim 1, wherein said LED lamp further comprises an exhaust chamber defined in said rear section of said housing.

7. The LED lamp of claim 1, wherein said LED lamp further comprises an exhaust outlet located between said cooling vane and said fan.

8. The LED lamp of claim 1, wherein said LED lamp further comprises a reflector mounted in said housing for intensifying light emitted by said LED.

9. The LED lamp of claim 1, wherein said LED lamp further comprises a bracket extending from said housing and configured for attachment of said housing to a head strap.

10. The LED lamp of claim 1, wherein said LED lamp further comprises a bracket extending from said housing and configured for attachment of said housing to an arm secured to a structure.

* * * * *